US007451802B2

(12) United States Patent
Cianciolo et al.

(10) Patent No.: US 7,451,802 B2
(45) Date of Patent: Nov. 18, 2008

(54) SLIDABLE DOOR ASSEMBLIES WITH AUTOMATIC PIVOT LATCHING

(75) Inventors: John S. Cianciolo, Waukesha, WI (US); Aaron D. Clark, Burlington, WI (US)

(73) Assignee: Nabco Entrances, Inc., Muskego, WI (US)

( * ) Notice: Subject to any disclaimer, the term of this patent is extended or adjusted under 35 U.S.C. 154(b) by 0 days.

(21) Appl. No.: 11/435,510

(22) Filed: May 17, 2006

(65) Prior Publication Data

US 2007/0169899 A1 Jul. 26, 2007

Related U.S. Application Data

(60) Provisional application No. 60/761,988, filed on Jan. 25, 2006.

(51) Int. Cl.
*E05D 15/00* (2006.01)

(52) U.S. Cl. ..... 160/211; 160/210; 160/223; 160/225

(58) Field of Classification Search ..... 160/211, 160/210, 223, 225, 226, 197, 202
See application file for complete search history.

(56) References Cited

U.S. PATENT DOCUMENTS

| | | | | |
|---|---|---|---|---|
| 704,887 | A * | 7/1902 | Low | 49/73.1 |
| 4,619,074 | A | 10/1986 | Leung et al. | |
| 4,635,699 | A * | 1/1987 | Kauffman et al. | 160/211 |
| 5,832,980 | A * | 11/1998 | Cianciolo | 160/197 |
| 6,068,041 | A * | 5/2000 | Miles et al. | 160/135 |
| 6,161,334 | A * | 12/2000 | Goodin | 49/125 |
| 6,170,195 | B1 * | 1/2001 | Lim | 49/196 |

OTHER PUBLICATIONS

Gyro Tech by NABCO Entrances, Inc. brochure, undated, admitted prior art.

* cited by examiner

*Primary Examiner*—Katherine Mitchell
*Assistant Examiner*—Candace L. Bradford
(74) *Attorney, Agent, or Firm*—Quarles & Brady LLP

(57) ABSTRACT

Disclosed are door assemblies particularly well suited for opening and closing wide entries such as emergency room entries. The assemblies have multiple doors that can be overlapped at a side of the entry. If further access room is needed the doors can then be pivoted so that essentially the entire entry is open. There is an automatic latching system that activates as the doors are being pivoted to prevent some sliding motion during the pivoting.

8 Claims, 9 Drawing Sheets

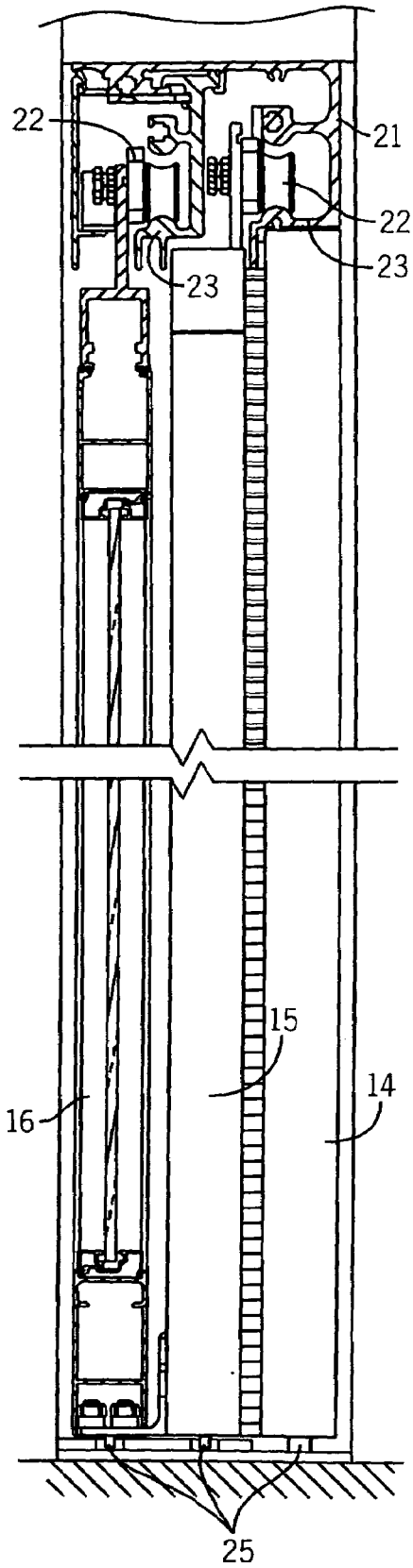
FIG. 7
FIG. 8
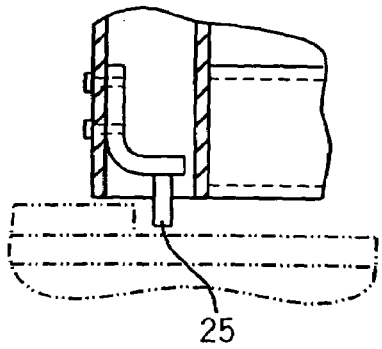

SLIDABLE DOOR ASSEMBLIES WITH AUTOMATIC PIVOT LATCHING

CROSS-REFERENCE TO RELATED APPLICATIONS

This application claims the benefit of U.S. provisional application 60/761,988 filed Jan. 25, 2006, hereby incorporated by reference.

STATEMENT REGARDING FEDERALLY SPONSORED RESEARCH/DEVELOPMENT

Not applicable

BACKGROUND OF THE INVENTION

The present invention relates to door assemblies of the type where there are multiple doors, at least one of which is mounted to slide along a header on a track to move from an overlapping/compact configuration to an extended position. More particularly, it relates to such assemblies where the doors can also be pivoted as a unit to provide even greater access through the entry after they have been overlapped.

Slidable door assemblies are often used to close off large entries such as entrances to big-box stores or entrances to emergency rooms. In many such applications it is desirable that the doors be fully supported without using a lower rail across the entry. If a shopping cart, forklift truck carrying pallets, hospital gurney, or even just a human is passing through such an entry it is highly desirable for them not to have to pass over any bump or other impediment. Hence, many door assemblies for such applications do not have a lower support rail.

When two-door or three-door assemblies have their doors overlapped to one side of the entry the doors still take up a considerable portion of the opening (e.g. 50 percent in a two-door assembly; about 35 percent in a three-door assembly). Some big-box stores address this problem by having the doors open in opposite directions and when they do so they pass behind walls at opposite sides of the entry. However, this requires there to be sufficient room at the sides of the entry for this to occur.

In some applications there is not enough adjacent wall space available for this. Hence, door assemblies have been designed where such doors are first overlapped at a side of the entry, and then pivoted so as to essentially completely expose the opening. For example U.S. Pat. No. 4,619,074 disclosed a convertible door system that allows the slidable doors to breakout of the supporting upper and lower tracks and to pivot away from the opening. However, the conversion from sliding to pivoting in this design required the extra step of manually moving of a lever.

Similarly, NABCO Entrances, Inc. produced a line of system doors which allowed two doors to slide into overlapping position relative to a pivot only door, and then permitted all three doors to be swung open. However, again, this line also required a separate non-automatic converting adjustment prior to the pivoting.

While these prior art door assemblies sufficed for many uses, to be used quickly and efficiently they required some training regarding how to make the conversion. For example, the employees on duty needed to know how to make the conversion from the sliding motion to the pivoting motion. Some customers prefer not to have to provide such training, particularly where there is likely to be a significant turnover in personnel over time or a large number of persons who may have responsibility for making the conversion.

Moreover, even with properly trained personnel a requirement for a manual conversion step requires some time to achieve it. Some customers, particularly those in an emergency room environment, may prefer to save that time by having a more automated conversion.

In another prior art approach there was a line of door systems which allowed two doors to slide into overlapping position relative to a pivot only door, and then permitted all three doors to be swung open without manual conversion adjustment of a mechanism prior to the pivoting. However, the mechanism to achieve this was in the upper header rail, was somewhat complex (and thus costly to produce), and in some constructions was somewhat susceptible to derailing if not properly used.

Hence, a need continues to exist for improved door assemblies, particularly those which both slide and pivot in a reliable manner without requiring non-automatic conversion adjustments.

BRIEF SUMMARY OF THE INVENTION

One aspect of the present invention provides a door assembly having a header, a door mounted for sliding movement along the header, and a panel positioned for pivoting relative to the header. The door is capable of sliding between a first position where the door and panel are at least partially overlapped with respect to each other, and a second extended position where the door is less overlapped with respect to the panel than in the first position or not overlapped with the panel.

There is also a pivot base having an actuator. The assembly is configured such that contact of the panel with the actuator when the panel is positioned essentially parallel to the door facilitates unlatching of the door to permit it to slide along the header. Pivoting of the panel to a position not essentially parallel with the door facilitates the actuator causing a latch associated with the pivot base to inhibit sliding movement of the door along the header, while permitting pivoting of the door when the panel pivots.

In a preferred form the latch is spring biased so as to automatically move to a latching position as the panel is being pivoted. The latch may have a belly recess for receiving the actuator in a guided fashion.

In another aspect the invention provides a door assembly having a header, a first door mounted for sliding movement along the header, a second door mounted for sliding movement along the header, and a panel positioned for pivoting relative to the header. The first door is capable of sliding between a first position where the door and panel are at least partially overlapped with respect to each other, and a second extended position where the door is less overlapped with respect to the panel than in the first position or not overlapped with the panel. The second door is capable of sliding between a first configuration where the first door and second door are at least partially overlapped with respect to each other, and a second extended configuration where the second door is less overlapped with respect to the first door than in the first configuration or not overlapped with the panel.

There is also a pivot base having an actuator. The assembly is configured such that contact of the panel with the actuator when the panel is positioned essentially parallel to the first door facilitates unlatching of the first door to permit it to slide along the header, and contact of the panel with the actuator when the panel is positioned essentially parallel to the first door also facilitates unlatching of the second door to permit it to slide along the header. Also, pivoting of the panel to a position not essentially parallel with the door facilitates the actuator causing a latching system associated with the pivot base to inhibit sliding movement of both the first and second doors along the header, while permitting pivoting of the doors when the panel pivots.

In another preferred form the latching system can have a first latch for inhibiting sliding movement of the first door and a second latch for inhibiting sliding movement of the second door, wherein motion of the first latch can cause motion of the second latch. Alternatively, the latching system can have a latch having two hooks, one for inhibiting sliding movement of the first door, and a second for inhibiting sliding movement of the second door.

Hence, it will be appreciated that the present invention provides a mechanism such that just as the doors (e.g. one sliding door plus one pivoting panel; or multiple sliding doors plus pivoting panel) begin to pivot the pivoting motion releases pressure against the actuator, thereby causing a latching to occur automatically. The slidable doors are thereby prevented from undesirable outward motion as the doors are being pivoted.

The present invention thus reduces the time needed to make the conversion from sliding to pivoting (as compared to manual intervention conversion systems), and avoids the need for any special training relating to the conversion. Such systems are also relatively inexpensive to produce and reliable.

The foregoing and other advantages of the present invention will be apparent from the following description. In the description that follows reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 7 is a view taken along line 7-7 of FIG. 2;

FIG. 8 is a detailed sectional view of a corner of one of the doors showing a lower mounting pin structure depending there from;

DETAILED DESCRIPTION OF THE INVENTION

Figure 1:
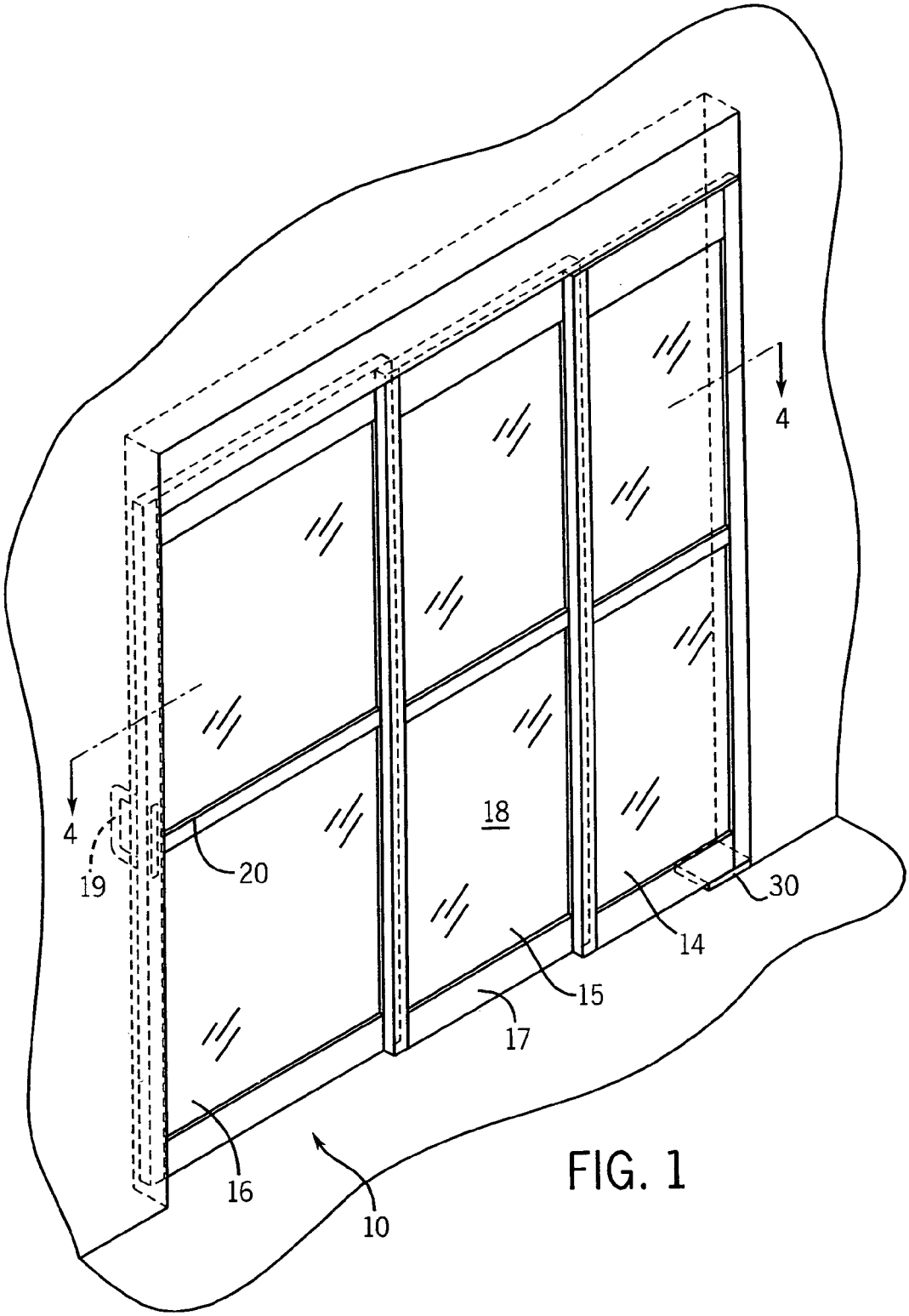
FIG. 1 is a left upper perspective view of a door assembly of the present invention positioned to close off an entry.
Figure 2:
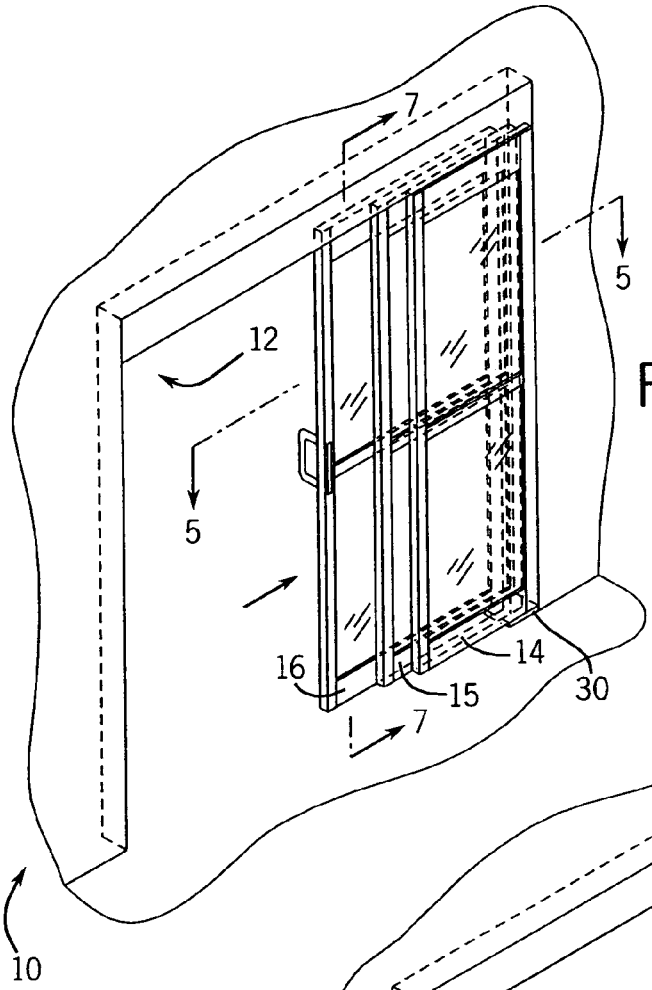
FIG. 2 is a view similar to FIG. 1, but with two of the doors slid to one side of the opening.
Figure 3:
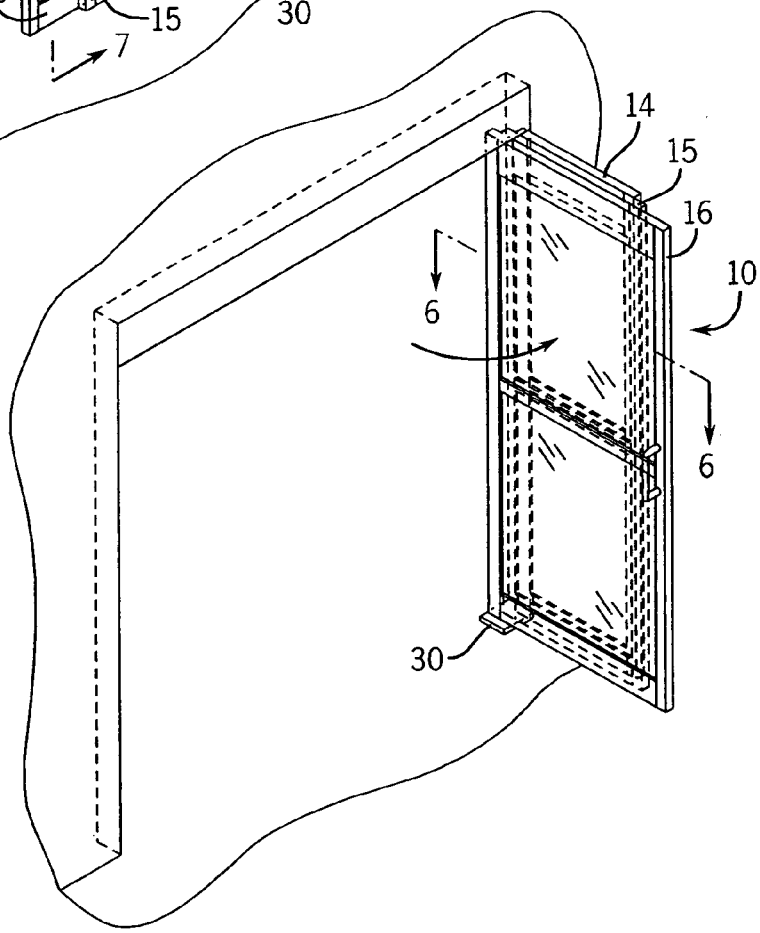
FIG. 3 is a view similar to FIG. 1, but with the three doors shown as pivoted 90 degrees relative to a longitudinal axis of the opening.
Figure 4:
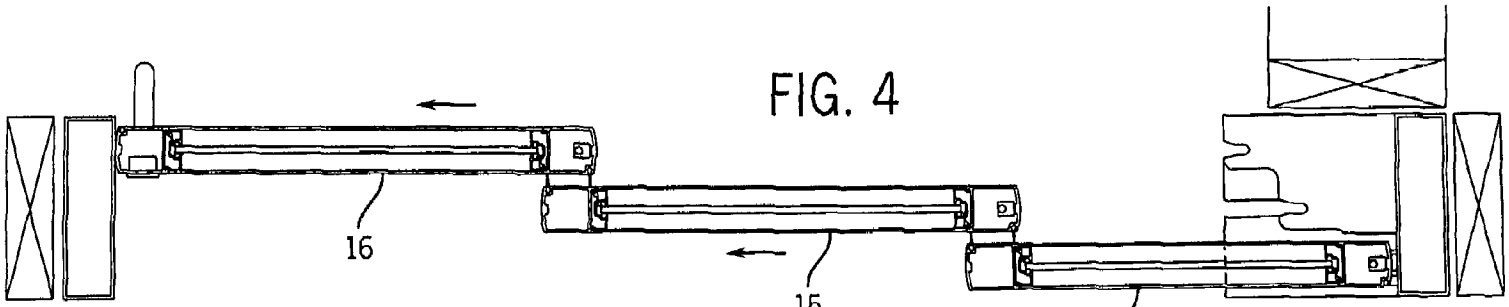
FIG. 4 is a view taken along line 4-4 of FIG. 1, with some of the parts shown in schematic form.

FIGS. 1-3 illustrate a first embodiment of a slidable door assembly 10 of the present invention. The assembly is shown as controlling access through an entry 12, such as one might find in a hospital emergency room area. The slidable door assembly 10 has a swing panel 14 which preferably merely pivots. The assembly also has a lead panel 16 which slides along the entry (and as will be discussed below also pivots). In the FIG. 1 embodiment, there is also a trailing panel 15 intermediate the swing panel 14 and lead panel 16 which slides along the entry (and also pivots).

These panels are conventional in most respects. For example they can be formed mostly of glass 18 with a surrounding frame 17. Alternatively, the panels may be made of opaque material, particularly where the door serves a privacy or security function. There may also be a conventional handle 19 mounted on the lead door and bracing 20. Alternatively, a powered system can drive movement of the panels.

Figure 5:
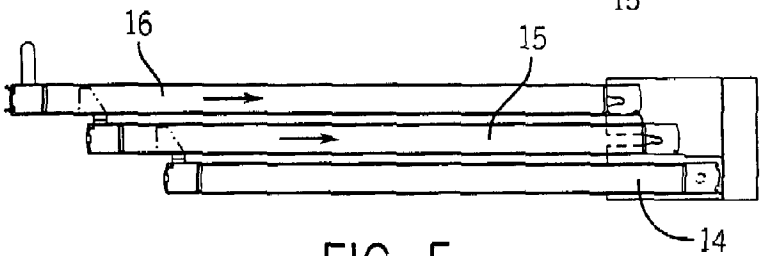
FIG. 5 is a view taken along line 5-5 of FIG. 2, with some of the additional jamb parts not shown.
Figure 6:
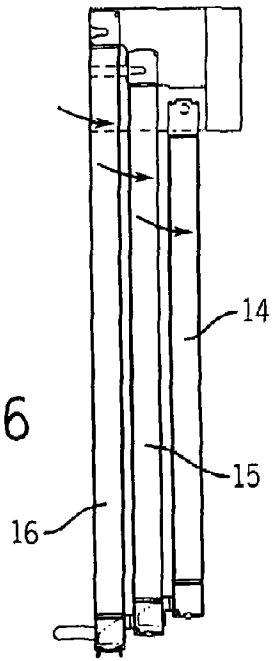
FIG. 6 is a view taken along line 6-6 of FIG. 3, again with some of the jamb parts not shown.

In any event, as best seen in FIG. 7, a header 21 is provided. The lead panel 16 and the trailing panel 15 each have at their upper end a conventional hanging roller assembly 22 which rides on a conventional track 23 when the lead or trailing panels are extended relative to the pivot base. When the lead and trailing panels are as shown in FIG. 5, the roller assemblies will still be parallel to a longitudinal axis of the opening. However, near the end of the entry where the panels overlap the raised rail bumps on the track may in a first embodiment flatten out and the header may in that embodiment be formed with an opening in its walls. This would permit the lead panel and trailing panels to pivot off the track as shown in FIG. 6.

Figure 9:
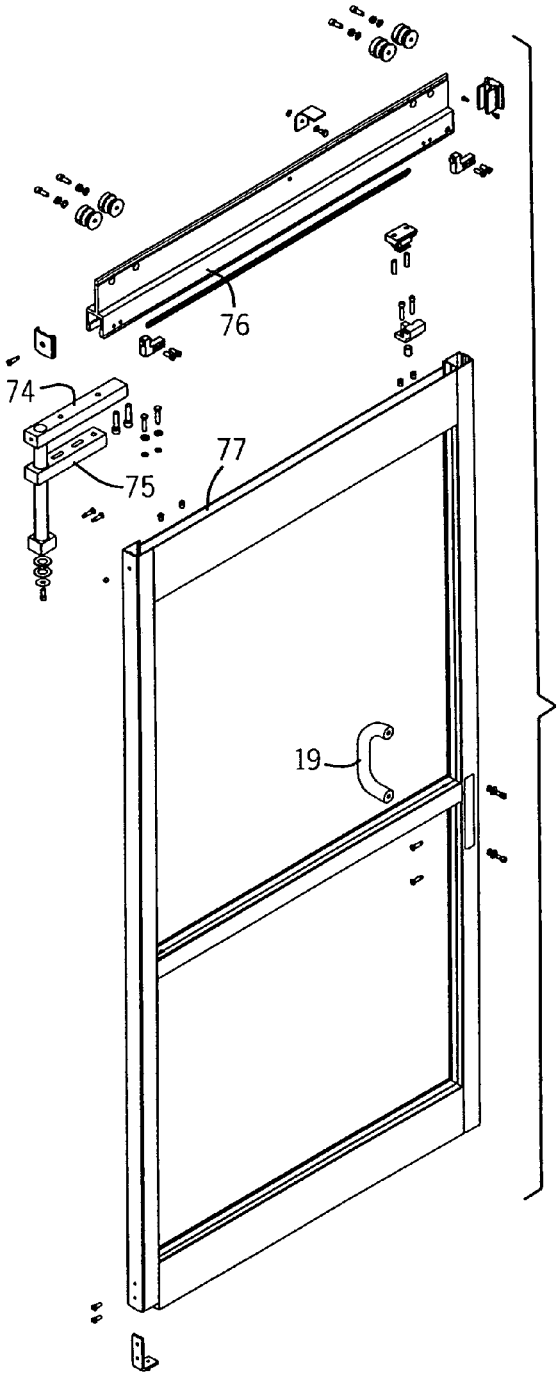
FIG. 9 is an exploded perspective view of another form of the lead door 16 and associated support structure, with additional upper pivot facilitating structure shown.
Figure 10A:
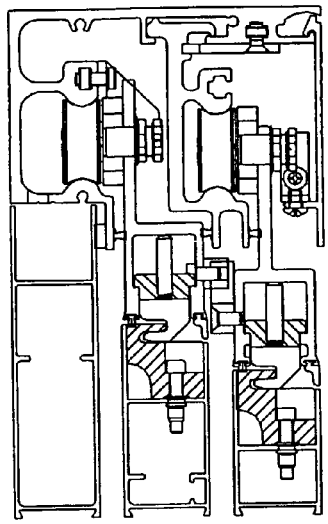
FIG. 10 is a grouping of selected sectional views depicting how the FIG. 9 lead door might be used in an alternative overall door assembly.
Figure 10B:
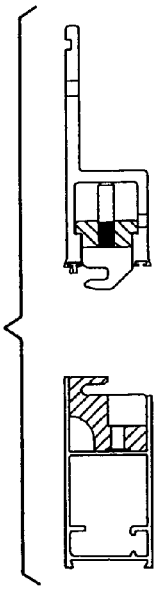
Figure 11:
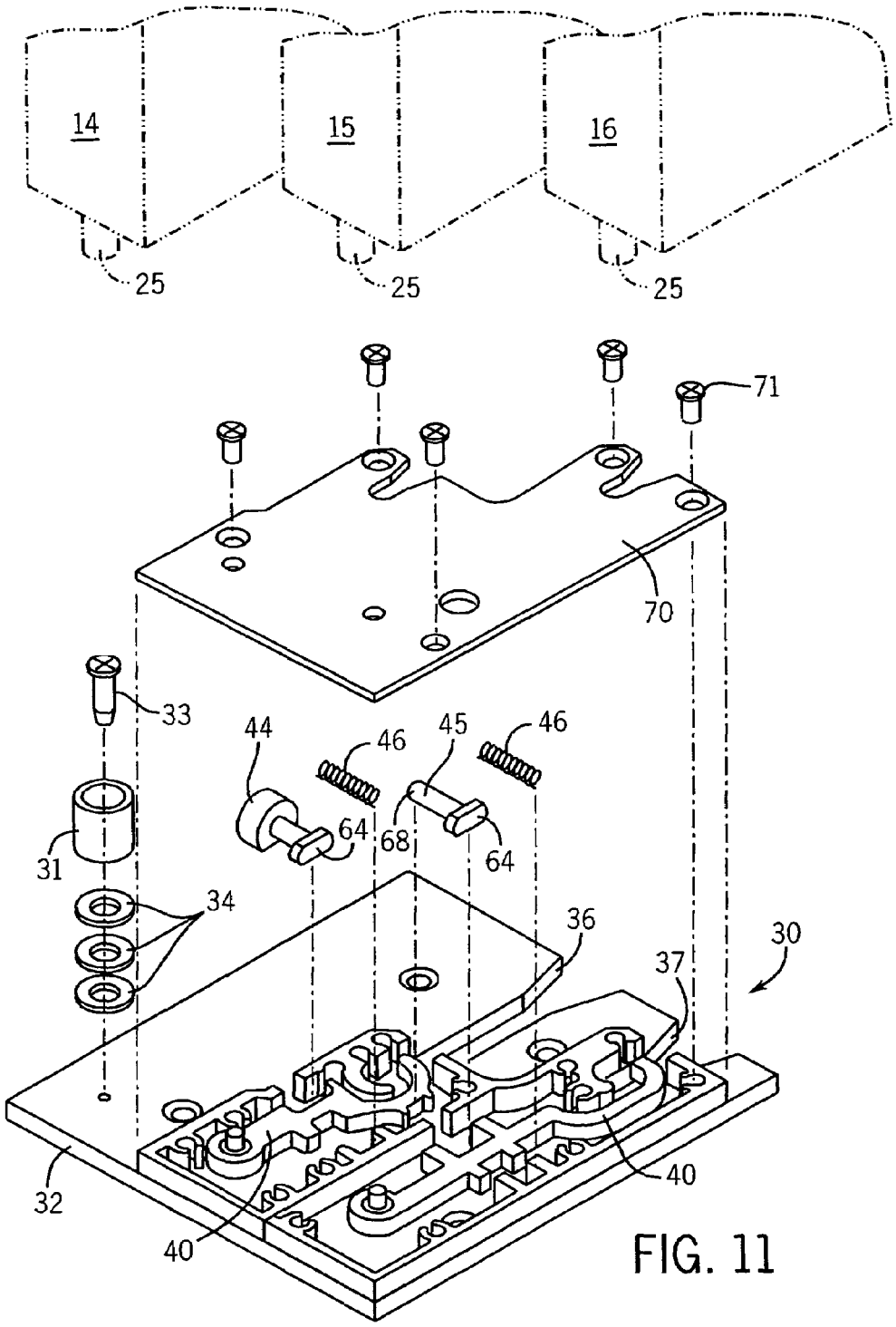
FIG. 11 is an exploded view of a pivot base used with a door assembly.
Figure 12:
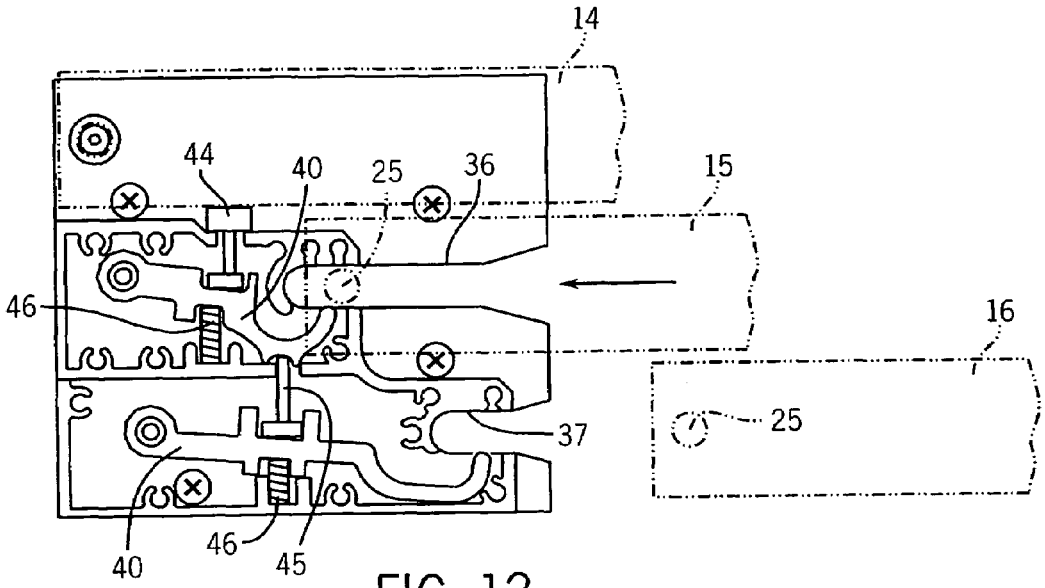
FIG. 12 is a horizontal sectional view through a portion of the assembly adjacent the pivot base, particularly depicting how neither latch is engaged when the swing door is parallel to the opening and the trailing door is in the process of being harbored at the pivot base.
Figure 13:
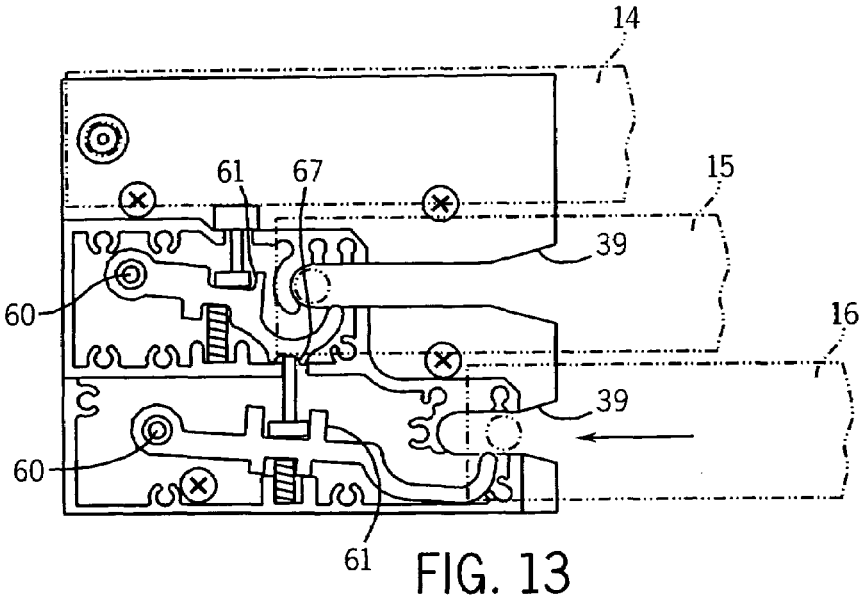
FIG. 13 is a view similar to FIG. 12, with the latches positioned as in FIG. 12 even though the trailing door is fully harbored at the pivot base and the lead door is in the process of being harbored at the pivot base.
Figure 14:
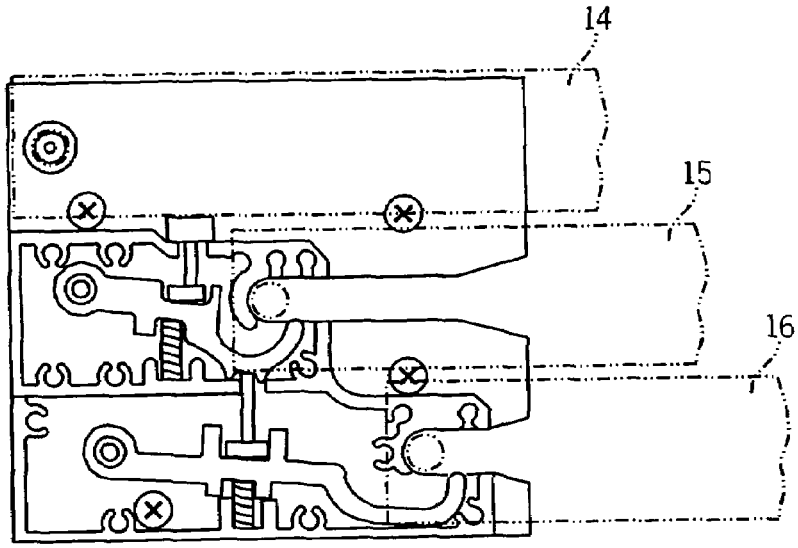
FIG. 14 is a view similar to FIG. 13, with the latches positioned as in FIG. 13 even though both the trailing door and lead door are fully harbored at the pivot base.

Of course, a variety of other upper pivot enabling constructions can alternatively be used at the upper portion of the designs. For example, FIGS. 9 and 10 depict another known form of upper break away construction. In that design, bars 74 and 75 link to parts 76 and 77 respectively, yet permit a relative rotation there between when pivoting is desired.

It should be noted that while a header construction will in either embodiment extend across the entry 12, it is highly preferred that the door assemblies of the present invention be used without a footer rail or footer track. As a result, anything being moved through the entry does not have to jump over or bounce on an obstruction. Note also that lower pivot pins 25, while extending downwardly, do not contact the floor across the entry as the panels 15 and 16 slide across the entry.

In accordance with the most important aspect of the present invention, the assembly 10 also has a pivot latch assembly 30 provided at a lower corner of the entry near where the three panels are harbored when they overlap. This assembly 30 could be positioned at a left corner or at a right corner. The assembly 30 will operate in a similar manner in either case, albeit the parts will be mirror image.

FIGS. 11-15 show in more detail the pivot latch assembly 30 and how it operates with varying positions of the swing panel 14, trailing panel 15 and lead panel 16. The swing panel 14 pivot pin 25 is mounted in a cylinder 31 of the pivot latch assembly 30. That cylinder is screwed onto main base 32 using a screw 33 and washers 34. An upper end of the swing panel has a similar pivot pin, not shown which interacts with the header. The swing panel 14 can freely pivot from the FIG. 12 position to the FIG. 15 position, but in preferred embodiments cannot slide along the entry.

As shown in FIG. 1, when the panels 15 and 16 are extended, the lead panel 16 extends further than the trailing panel 15. As the panels 15 and 16 begin to overlap, and panel 15 begins to overlap with panel 14, as shown in FIG. 10 the pin 25 of panel 15 will first enter a slot 36 of the base 32 before the corresponding pin 25 of panel 26 reaches slot 37. As the overlapping continues, the pins 25 of panels 15 and 16 will then reach the FIG. 13 position, followed by the FIG. 14 position.

Figure 15:
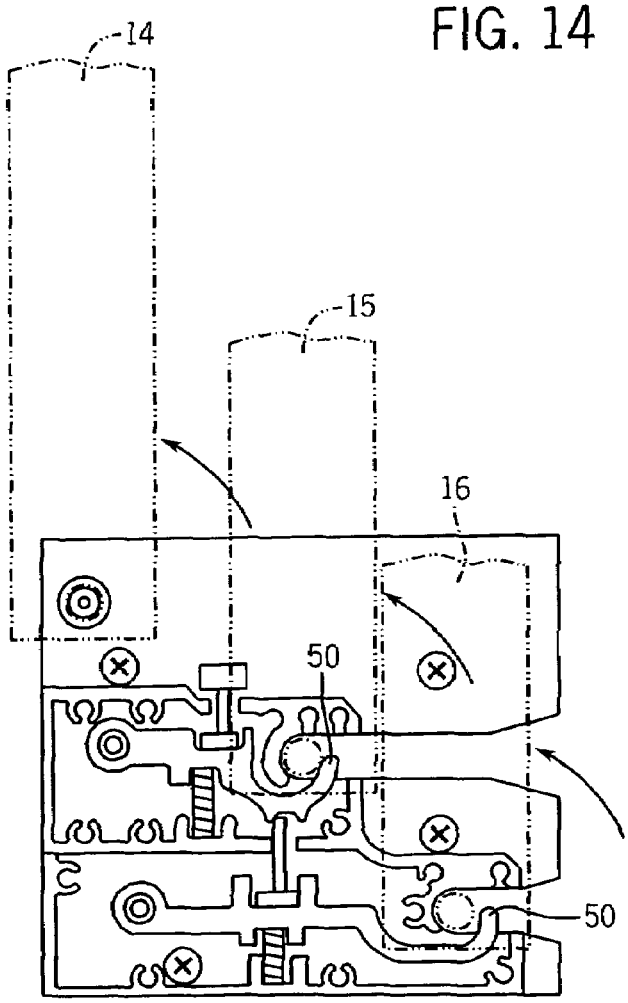
FIG. 15 is a view similar to FIG. 14, albeit with the latches engaging lower pivot pins of the lead and trailing doors since the three doors have pivoted outward.

In all of these positions except for the FIG. 15 position the latches 40 will be held away from the pins 25 by a plunger 44 acting against one latch 40, the latter latch then holding a second plunger 45 against a second latch 40. Both of the latches 40 will have such positioning opposed by springs 46. However, the force of the springs 46 will not be sufficient to move the panels 14-16 from the FIG. 12 position to the FIG. 15 position.

As the panels 14-16 are being pivoted together to the FIG. 15 position, there will no longer be a large force on the plunger 44. Hence, the springs 46 can drive the latches so that the ends 50 of the latches can catch and trap the pins 25 just as the pivoting begins. Thus, the pivot latch assembly 30 operates as an automatic latching system that traps the pins to prevent the lead panel 16 and trailing panel 15 from flying outward during pivoting. Reverse pivoting to return the doors to the FIG. 12 position, and thus automatically releases the latches.

Some other details of interest are that the latches are pinned for pivoting on vertical pins 60. Also, each latch 40 has along its "belly" a receiving area 61 for aligning heads 64 of the plungers 44/45. Note also that the rear of one of the latch heads has an alignment pocket 67 for guiding an end 68 of a plunger.

Further, the internal structure can be covered and protected by a plate 70 that is fastened with appropriate screws 71. Another preferred feature is that the slots 36 and 37 are formed with tapered entries 39 so that if the panels 15/16 are swinging slightly as they are overlapped, the pins 25 will still be readily guided to the right capturing position.

It should be appreciated that when the panels 14-16 are positioned as in FIG. 3, the entry is essentially completely open. This positioning can be achieved by sliding the doors from the FIG. 1 position to the FIG. 2 position, and then pivoting the doors to the FIG. 3 position, without any other manual intervention. This is achieved because a side lower wall of the swing panel 14 automatically contacts the plunger 44 whenever it is parallel to the entry, and when that panel is pivoted open the springs can activate the latching.

Figure 16:
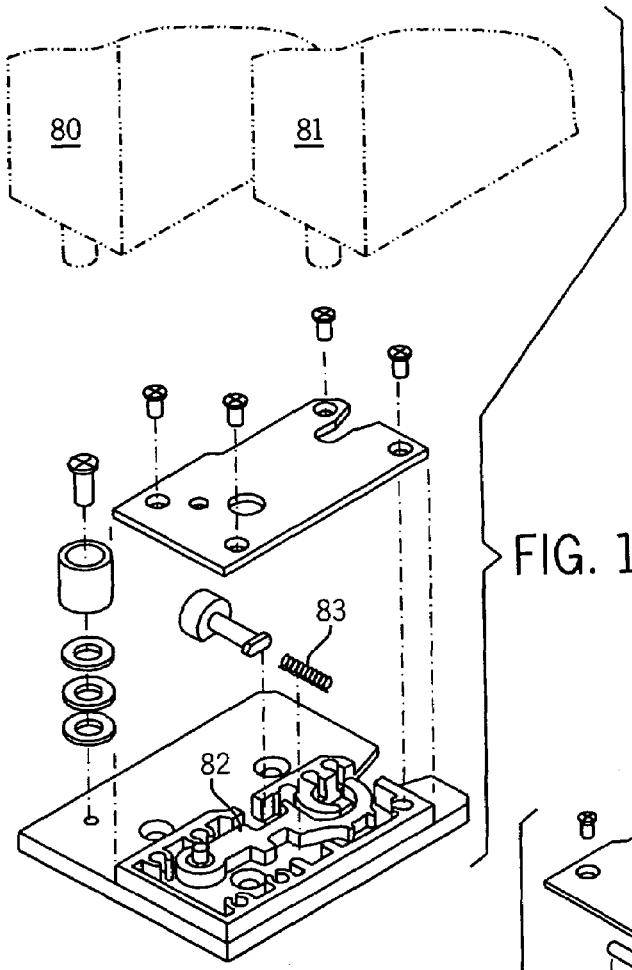
FIG. 16 is a view similar to FIG. 11, but of a second embodiment not having a trailing door.
Figure 17:
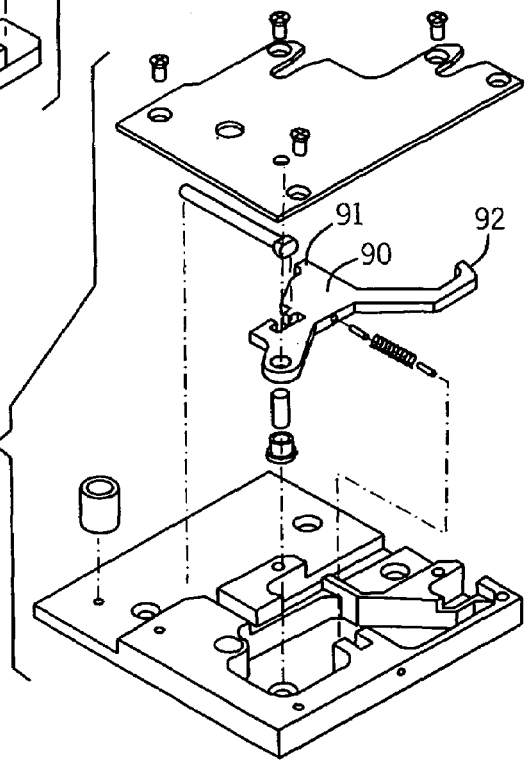
FIG. 17 is a view similar to FIG. 16, but of a third embodiment showing alternative latching structures, where a single latch can latch to sliding doors.

Turning now to FIG. 16, it can be seen that for some entries one may prefer to have only two doors 80 and 81, yet still have the pivoting and automatic latching features. In this embodiment the door 80 acts and is mounted essentially the same as the swinging panel 14. Further, door 81 acts, is mounted, and is latched quite similar to how panel 15 acts, is mounted and is latched. However, in this embodiment the first latch 82 does not drive a second plunger and latch, there is no third panel 16, and there is only one spring 83.

Turning next to FIG. 16, a three-door structure is shown as being implemented with only one latch 90 instead of two. In this device the movable latch has two blockers 91 and 92 on a single latch.

While preferred embodiments of the present invention have therefore been described, it should be appreciated that there are other embodiments of the invention within the spirit and scope of this disclosure. For example, it is not critical that the panel 14 not be slidable. A device could be configured to simultaneously trap all three doors for pivoting, while permitting all three to slide.

Hence, the invention is not to be limited to just the specific embodiments shown or described. Thus, reference should be made to the following claims in order to judge the full scope of the invention.

INDUSTRIAL APPLICABILITY

The present invention provides door closure assemblies that can automatically convert between sliding motion and pivoting motion to optimize access through the entry.

We claim:

1. A door assembly for mounting across an entry, comprising:

a header;

a door mounted for sliding movement along the header, a member extending from the door;

a pivot base having an actuator and a latch configured to capture said member of the door;

a panel positioned for pivoting on the pivot base relative to the header;

the door being capable of sliding between a first position where the door and panel are at least partially overlapped with respect to each other, and a second extended position where the door is less overlapped with respect to the panel than in the first position or not overlapped with the panel;

whereby the assembly is configured such that contact of the panel with the actuator when the panel is positioned essentially parallel to the entry facilitates unlatching of the door to permit it to slide along the header and entry; and whereby pivoting of the panel to a position not essentially parallel with the entry automatically facilitates the actuator causing the latch to capture the member to inhibit sliding movement of the door along the header, while permitting pivoting of the door when the panel pivots.

2. The door assembly of claim 1, wherein the latch is spring biased so as to automatically move to a latching position as the panel is being pivoted, the member being captured by the latch in the latching position.

3. The door assembly of claim 2, wherein the latch is formed with a recess along its belly to receive a portion of the actuator.

4. The door assembly of claim 1, wherein the member is a pin.

5. A door assembly for mounting across an entry, comprising:

a header;

a first door mounted for sliding movement along the header, a first member extending from the first door;

a second door mounted for sliding movement along the header, a second member extending from the second door;

a panel positioned for pivoting relative to the header;

the first door being capable of sliding between a first position where the door and panel are at least partially overlapped with respect to each other, and a second extended position where the door is less overlapped with respect to the panel than in the first position or not overlapped with the panel;

the second door being capable of sliding between a first configuration where the first door and second door are at least partially overlapped with respect to each other, and a second extended configuration where the second door is less overlapped with respect to the first door than in the first configuration or not overlapped with the panel;

a pivot base having an actuator and a latching system configured to capture the first member and the second member;

whereby the assembly is configured such that contact of the panel with the actuator when the panel is positioned essentially parallel to the entry facilitates unlatching of the first door to permit it to slide along the header and entry;

whereby the assembly is configured such that contact of the panel with the actuator when the panel is positioned essentially parallel to the entry also facilitates unlatching of the second door to permit it to slide along the header; and whereby pivoting of the panel to a position not essentially parallel with the entry facilitates the actuator causing the latching system to capture the first and second members and to inhibit sliding movement of both the first door and the second door along the header, while permitting pivoting of the first door and second door when the panel pivots.

6. The door assembly of claim 5, wherein the latching system comprises a first latch for capturing the first member thereby inhibiting sliding movement of the first door and a second latch for capturing the second member thereby inhibiting sliding movement of the second door, wherein motion of the first latch can cause motion of the second latch.

7. The door assembly of claim 5, wherein the latching system comprises a latch having two hooks, one for capturing the first member thereby inhibiting sliding movement of the first door, and a second for capturing the second member thereby inhibiting sliding movement of the second door.

8. The door assembly of claim 5, wherein the first and second members are pins.

* * * * *